United States Patent [19]

Bose et al.

[11] Patent Number: 4,801,330

[45] Date of Patent: Jan. 31, 1989

[54] HIGH STRENGTH, HIGH HARDNESS TUNGSTEN HEAVY ALLOYS WITH MOLYBDENUM ADDITIONS AND METHOD

[75] Inventors: Animesh Bose, Troy; Randall M. German, Latham, both of N.Y.; David M. Sims, Bonners Ferry, Id.

[73] Assignee: Rensselaer Polytechnic Institute, Troy, N.Y.

[21] Appl. No.: 48,703

[22] Filed: May 12, 1987

[51] Int. Cl.[4] ..... B22F 1/00

[52] U.S. Cl. ..... 75/298; 419/47; 419/58; 420/430

[58] Field of Search ..... 75/248; 419/47, 58; 420/430

[56] References Cited

U.S. PATENT DOCUMENTS

| | | | |
|---|---|---|---|
| 2,793,951 | 5/1957 | Green et al. | 75/214 |
| 2,843,921 | 7/1958 | Ang | 75/248 |
| 3,656,731 | 4/1972 | Larsen | 75/248 |
| 3,888,636 | 6/1975 | Sczerzenie et al. | 75/227 |
| 3,929,424 | 12/1975 | Krock et al. | 75/200 |
| 3,988,118 | 10/1976 | Grierson | 75/248 |

OTHER PUBLICATIONS

Canadian Mining and Metallurgical Bulletin for Apr. 1965, Montreal, Canada, E. I. Larsen and P. C. Murphy, Characteristics and Applications of High-Density Tungsten-Based Composites, pp. 413-421.

Powder Metallurgy International, vol. 5, No. 3, 197, Preparation and Properties of Heavy Metals, E. Ariel, J. Barta and D. Brandon, pp. 126-127.

*Primary Examiner*—Stephen J. Lechert, Jr.

*Attorney, Agent, or Firm*—Heslin & Rothenberg

[57] ABSTRACT

A tungsten heavy alloy system is modified by partial replacement of the tungsten with substantial amounts of molybdenum ranging from 2% to 16% by weight to produce a new alloy with greater strength and hardness and moderate ductility. This new alloy is particularly useful for kinetic energy penetrators. The process involved is liquid phase sintering in an atmosphere of dry hydrogen, then wet hydrogen, then argon, followed by heat treament at 1100° C. with a water quench. The resulting alloy is further hardened by swaging and strain aging which, at certain levels of molybdenum, produces a material having hardness in excess of HRC 45.

5 Claims, 5 Drawing Sheets

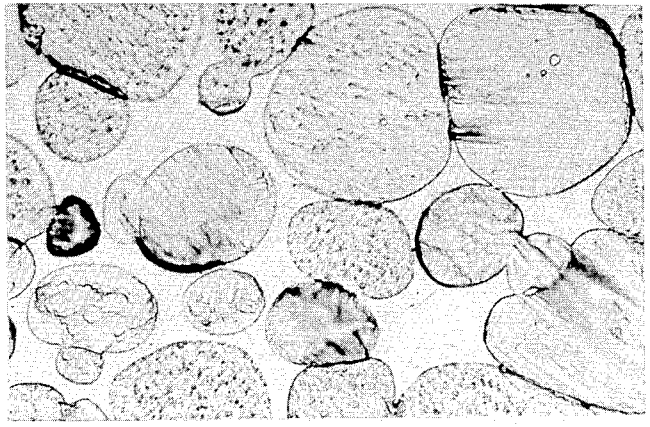
FIG. 7(a) 90W - 7Ni - 3Fe
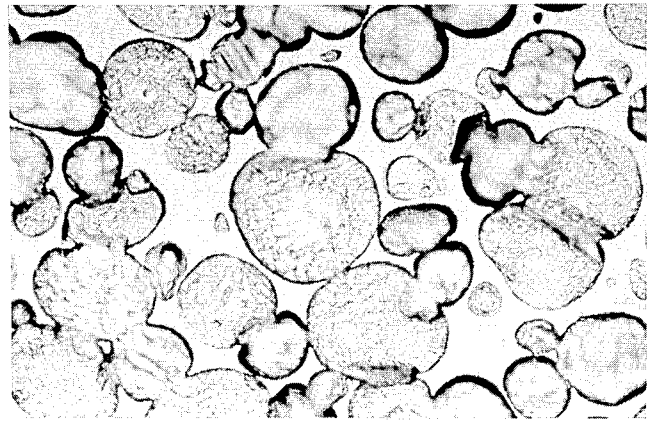
FIG. 7(b) 86W - 4Mo - 7Ni - 3Fe
15 μm
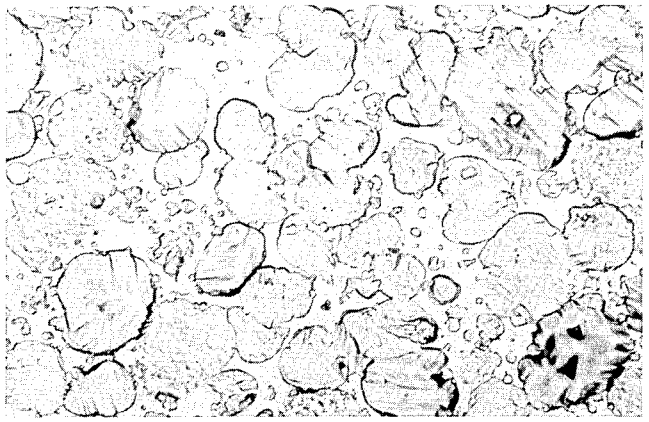
FIG. 7(c) 82W - 8Mo - 7Ni - 3Fe
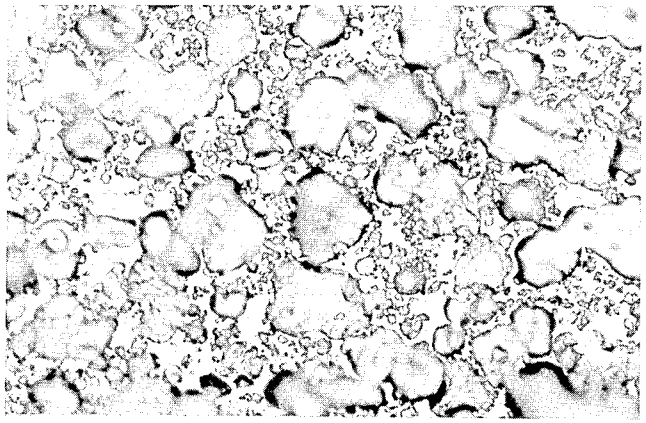
FIG. 7(d) 74W - 16Mo - 7Ni - 3Fe

HIGH STRENGTH, HIGH HARDNESS TUNGSTEN HEAVY ALLOYS WITH MOLYBDENUM ADDITIONS AND METHOD

BACKGROUND OF THE INVENTION

This invention was made with Government support under U.S. Army Grant No. DAAD05-86-M-3777 awarded by the Department of the Army. The Government has certain rights in this invention.

This invention relates to heavy metal alloy systems and, in particular, to such systems in which strength and hardness is increased through molybdenum additions while retaining a moderate level of ductility. A process for making such alloy products is also disclosed.

In this application, reference to "classic tungsten heavy alloy system" shall mean the alloy composed nominally of 90% by weight of tungsten as its major constituent and nickel and iron in the ratio of 7:3 as its minor constituent.

Tungsten heavy alloys have attractive property combinations of relatively high density, high strength, high ductility and easy machinability. As a result, this class of alloys is very useful for numerous applications like radiation shields, counterbalances, heavy duty electrical contacts, vibration dampers and, to some extent, kinetic energy penetrators. However, their usefulness, particularly as kinetic energy penetrators, can be enhanced if their strength and hardness can be made even higher while retaining moderate ductility, say 1 or 2%, and a reasonably high density, say 15 g/cc or above. There has been some attempt to improve the strength of these alloys by alloying additions like cobalt, chromium, rhenium, platinum, titanium, small amounts of molybdenum and aluminum, but they have not been very successful. Typically, the ductility of the alloys is significantly lowered by these additions which tend to form embrittling intermetallic phases.

Also, in the past, there has been relatively little effort to increase the hardness of heavy alloys through alloying. Until now kinetic energy penetrators, especially those used for piercing heavy armor plates, have been made with depleted uranium as an important constituent. This material is, of course, both toxic and expensive. It would, therefore, be highly desirable if a new material could be found which has the necessary mechanical properties, which is relatively inexpensive and which does not pose a hazard to health or require special handling procedures.

SUMMARY OF THE INVENTION

We have discovered that by doping the classic tungsten heavy alloy system by partial replacement of the tungsten with substantial amounts of molybdenum, ranging from 2% to 16%, it is possible to produce a material of sufficient density, hardness, strength and ductility for optimum use in kinetic energy penetrators.

Classic tungsten heavy alloy systems have been made through the process of liquid phase sintering. In those alloy systems, the nickel and iron take tungsten into solution in fairly significant amounts. The addition of molybdenum in the formulation and the use of the process of this invention brings about the improved hardness and strength for two apparent reasons. First, the molybdenum goes into solution with both the tungsten phase and the nickel iron matrix to produce solid solution hardening. Secondly, our invention results in grain size refinement. It is believed that this occurs because the presence of molybdenum in the nickel-iron matrix limits the amount of tungsten which that matrix would normally dissolve. As a result, the well known solution-reprecipitation phenomenon which normally occurs in liquid phase sintering of tungsten heavy alloys is lessened, thereby inhibiting the usual growth in grain size associated therewith.

The process of this invention, briefly described, involves the use of an optimized liquid phase sintering cycle in which dry hydrogen is used during reduction of the material being sintered and wet hydrogen is used thereafter until the final phase of the cycle when the wet hydrogen atmosphere is replaced with dry argon. The process also involves heat treatment by water quenching followed by swaging and strain aging of the material.

DETAILED DESCRIPTION

FIG. *7a–7d* is a four-part figure consisting of four micrographs showing grain structures for as-sintered samples of classic heavy alloy and for 4%, 8% and 16%-molybdenum doped classic heavy alloy.

Figure 8:
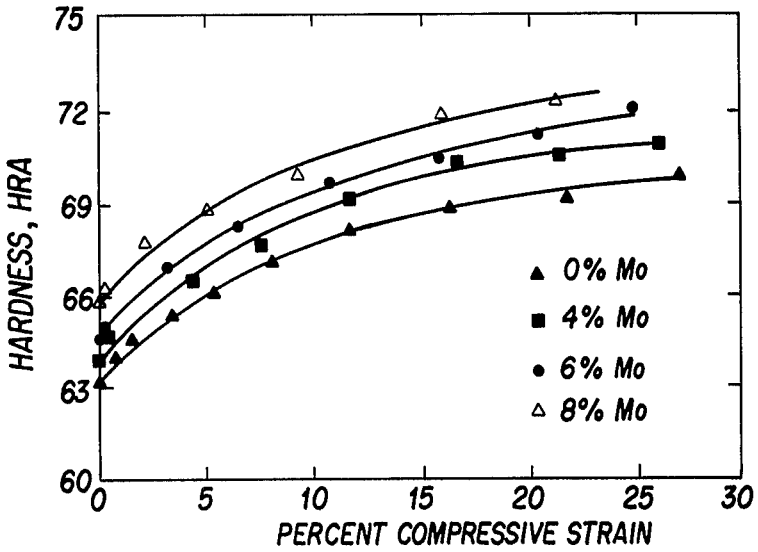

FIG. 8 is a graph showing the variation in hardness at selected levels of compressive strain for the classic heavy alloy and for 4%, 6% and 8%-molybdenum doped heavy alloys.

Figure 9:
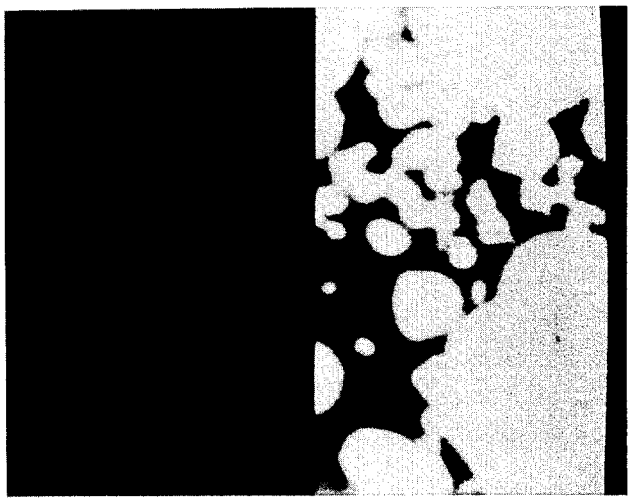

FIG. 9 is a two-part figure, the left half being a scanning electron micrograph of the alloy structure of a 78W-12Mo-7Ni-3Fe heavy alloy while the right half is an x-ray map of that same area.

Figure 1:
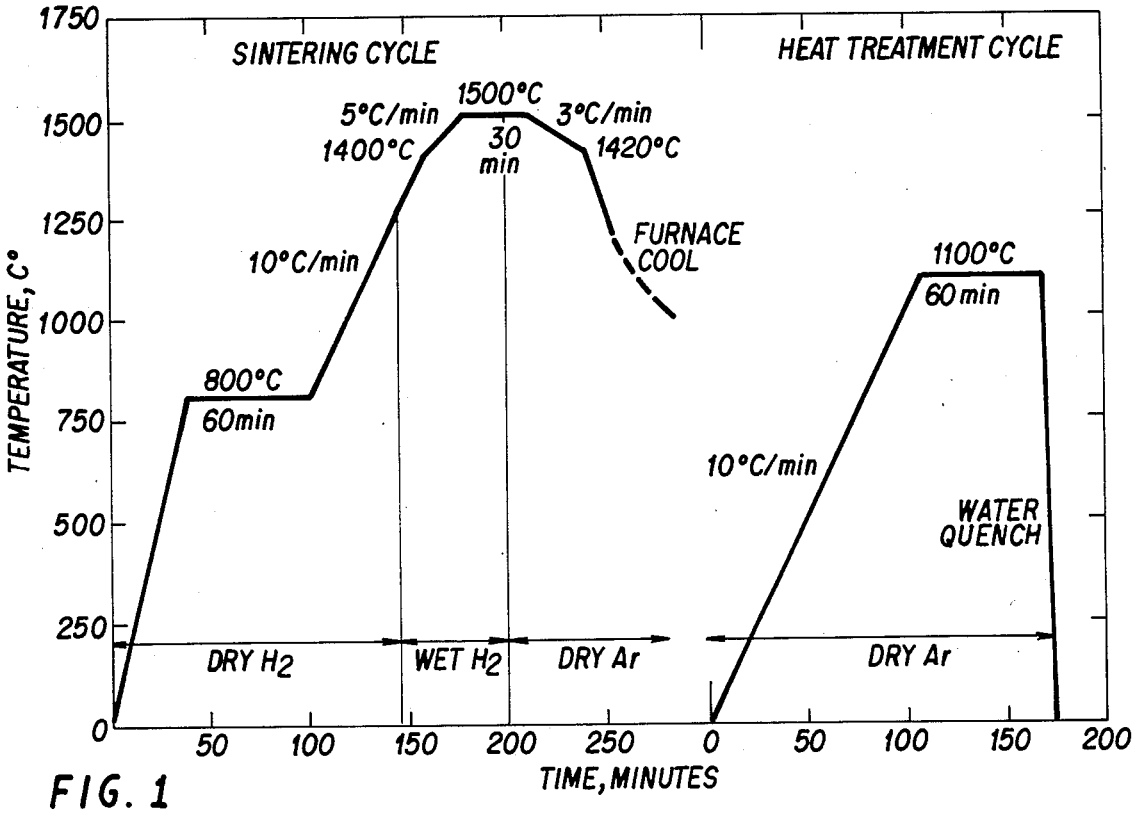
FIG. 1 is a graphical illustration of the sintering and heat treatment cycles employed in the invention.
Figure 2:
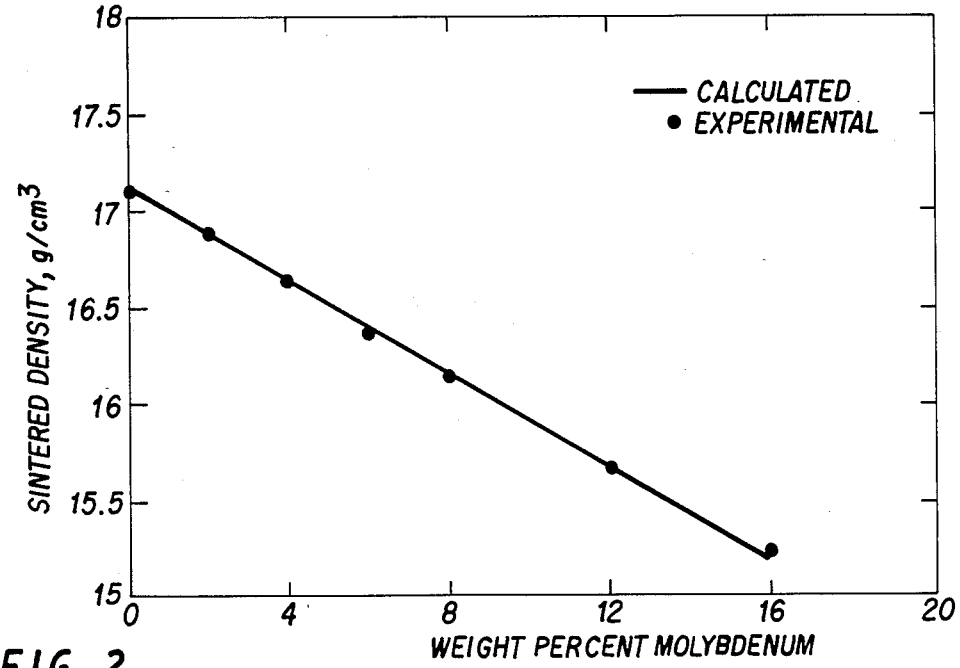
FIG. 2 is a graph showing calculated and experimental as-sintered densities of the products of the invention.

FIG. 1 illustrates the details of the sintering and heat treatment aspects of the invention. A compact to be sintered is first prepared. This has been done in the laboratory by placing elemental nickel and iron powders in the ratio of 7:3 by weight in a standard mixer for one hour. To this premix of nickel and iron, various amounts of elemental tungsten or both elemental tungsten and molybdenum were added. This final mix was then blended for one hour in the same mixer. Table I sets forth the powder characteristics below:

TABLE I

| | Powder Characteristics | | | |
|---|---|---|---|---|
| property | W | Ni | Fe | Mo |
| vendor | GTE | INCO | GAF | GTE |
| designation | M35 | 123 | HP | Mo-638 |
| purity, % | 99.98 | 99.992 | 99.55 | 99.96 |
| Fisher subsieve size, um | 2.5 | 2.8 | 3.0 | 5.2 |
| mean size*, um | 2.6 | 3.3 | 10.8 | 6.1 |
| BET specific surface area, $m^2/g$ | 0.23 | 2.19 | 0.88 | 0.64 |
| apparent | 2.57 | 2.15 | 2.20 | 2.03 |

TABLE I-continued

| property | Powder Characteristics W | Ni | Fe | Mo |
|---|---|---|---|---|
| density, g/cc | | | | |
| major impurities (ppm) | K(11) | Ca(10) | Ca(600) | Fe(28) |
| | Na(15) | Fe(30) | Al(600) | K(13) |
| | C(19) | Si(40) | Si(600) | C(10) |
| | O(770) | | O(300) | W(120) |
| | | | Mn(2000) | Ni(7) |

*forward laser light scattering

The compositions used are as follows:

(a) 90W-7Ni-3Fe
(b) 88W-2Mo-7Ni-3Fe
(c) 86W-4Mo-7Ni-3Fe
(d) 84W-6Mo-7Ni-3Fe
(e) 82W-8Mo-7Ni-3Fe
(f) 78W-12Mo-7Ni-3Fe
(g) 74W-16Mo-7Ni-3Fe

Composition (a) is included as an example of the classic heavy alloy system for comparison with the results achieved with compositions (b)-(g). Each of the compositions (b)-(g) is given here as an example of the invention.

Following the blending of metal powders, as described above, flat tensile bars with a pressing area of 645 $mm^2$ and a thickness of approximately 5 mm were compacted for each of the compositions (a)-(g). The compacting pressure was 275 MPa. During compaction, zinc stearate was used as the die wall lubricant.

Sintering was carried out in a horizontal tube furnace programmed to control the heating and cooling rates as well as the hold temperatures shown in FIG. 1. As there indicated, the sintering cycle begins with a relatively rapid heating of the compact to 800° C. The temperature is then held at that level for 60 minutes in an atmosphere of dry hydrogen for the purpose of reducing the oxygen content in the compact. Those skilled in the art will appreciate that the temperature and time for this prereduction hold need not be precisely at 800° C. and 60 minutes. It can, for example, be done at somewhat higher temperatures such as 900° C. and the time can be similarly varied. After the 800° C. hold, the temperature is increased at the rate of about 10° C./min.

We have found that it is beneficial to switch from dry hydrogen to wet hydrogen at about 1250° C. This is accomplished by passing hydrogen gas through a bubbler to pick up moisture before it enters the furnace. The purpose for switching to wet hydrogen is to retard the formation of vapor filled pores during the sintering cycle. Although this phenomenon is not fully understood, it is our belief that in the normal liquid phase sintering process in a dry hydrogen atmosphere, the dry hydrogen combines with residual oxygen that is released as the liquid phase dissolves parts of the tungsten solid phase to form water vapor. This water vapor becomes entrapped, particularly if the water vapor formation is relatively fast, and large numbers of bubbles form which can coalesce. Obviously, the longer the sintering temperature is maintained, the greater the bubble formation and the greater the number of pores found in the final product. Apparently, the use of wet hydrogen suppresses the rate of water vapor formation, thus retarding bubble formation. Those bubbles that do form are more likely to find their way out of the compact without encountering other bubbles along the way and coalescing with them. The use of this technique is particularly important in this invention because it permits the use of relatively long sintering times.

It should be noted that the choice of 1250° C. for shifting from dry hydrogen to wet hydrogen is based upon two considerations, oxygen reduction and pore formation. First, the dry hydrogen is retained as long as possible in order to get the maximum reduction. However, closed pores form as sintering temperature is raised. By making the shift to wet hydrogen sufficiently early (preferably before liquid forms) and thereby retarding gas bubble formation, the final product will be relatively freer of pores and hence, ductile. Thus, the temperature of 1250° C. can be varied without drastically changing the results, but we believe that temperature to be fairly close to the optimum for making the shift.

At about 1400° C., the heating rate is reduced to about 5° C./min. The purpose for using the slower heating rate is to provide sufficient time to allow the compact to develop full densification as liquid is formed.

When a temperature of 1500° C. is achieved, it is held for at least about 30 minutes. Depending upon the properties desired in the alloy product, this hold time can be increased substantially as a result of using a wet hydrogen atmosphere, as noted above. During the last ten minutes of the 1500° C. hold, the atmosphere is changed from wet hydrogen to dry argon gas. The purpose for doing so is to reduce hydrogen embrittlement of the alloy product which would otherwise occur. This technique permits the hydrogen to exit the system in an outward diffusion flow and we have found that it is advantageous to make the change to argon during the 1500° C. hold, or at least at a relatively high temperature.

At the end of the thirty minute hold, the temperature is reduced at the slow rate of 3° C./min. This slow rate is chosen until the temperature is below the melting point of the matrix in order to keep the formation of pores to a minimum. After solidification, the compact can be allowed to cool at a relatively fast furnace cooling rate. This can be accomplished by simply leaving the compact in place and allowing it to cool down with the furnace. After the compact has completely cooled, it is removed from the furnace and given the heat treatment shown in FIG. 1 which consists in elevating its temperature to 1100° C. and holding it there for approximately 60 minutes and then quenching the compact in water, all in an argon atmosphere. The purpose of this step is to suppress the segregation of impurities at the tungsten-matrix interfaces, thereby avoiding the embrittlement of the material.

The above described sintering and heat treatment cycle produces alloy products which have as-sintered densities greater than 99.5% of theoretical densities. The tensile bars were lapped after heat treatment to a 240 grit surface finish. The dimensions of the samples were carefully measured and a 20 mm gauge length was marked out on one of the flat surfaces of each. The hardness of the samples was then measured on the Rockwell A scale and an average of at least 18 values for each composition has been used to present the results depicted in FIG. 6. Also, the samples were pulled in tension using a crosshead speed of 0.004 mm/s. The elongation, yield and ultimate tensile strengths of the samples were measured using conventional techniques and the average of at least three specimens for each composition were used in preparing the graphical presentation of results shown in FIGS. 3, 4 and 5. On completion of the tensile tests, small pieces were sliced out from the end of the fractured bars, mounted, polished and etched to reveal their microstructures. The photomicrographs appearing in FIG. 7 were taken to illustrate the effect of molybdenum addition to the classic heavy metal alloy system.

To get some idea as to how the hardness of the alloys will change when they are swaged, interrupted compression tests were carried on cylindrical specimens of various compositions, as shown in FIG. 8. Small cylindrical samples were pressed, sintered and machined to give 10 mm diameter compression specimens. During the compression testing, the test was interrupted and the hardness was measured at different compressive strains. The result of the hardness variation with compressive strain, shown in FIG. 8, indicates the hardening potential of the molybdenum doped heavy alloys when swaged. At a compressive strain of 20%, the hardness of the heavy alloy with no molybdenum addition increased from 62.8 to 69.1 HRA, whereas the alloy with 8% molybdenum addition increased from 65.8 to 72.1 HRA. Strain aging the 8% molybdenum doped heavy alloy at 500° C. for 3 hours in an argon atmosphere increased the hardness of the alloy to 73.7 HRA (46 HRC). Thus, with a suitable molybdenum doped heavy alloy and appropriate swaging and aging, it is possible to obtain high hardness, heavy alloys with hardness above HRC 45.

It will be observed that the sintered density, strength, elongation, hardness and microstructure of the molybdenum doped heavy alloys make them attractive candidates for applications as kinetic energy penetrators and for the other applications mentioned above. Their properties in the as-sintered condition are attractive, but become even more impressive after swaging and strain aging. Table 2 is a tabulation of test results achieved on samples having the compositions illustrated after these samples have been subjected to swaging to an approximately 18% reduction in cross-sectional area, followed by aging for 3 hours at 500° C.:

TABLE 2

| Sample | Ultimate Tensile Strength U.T.S. MPa. | Yield Strength MPa. | Elongation |
|---|---|---|---|
| 90W | 1406 | 1309 | 2% |
| 7Ni—3Fe | 1433 | 1316 | |
| 86W—4Mo | 1468 | 1351 | 1% |
| 7NI—3Fe | 1406 | 1336 | |
| 82W—8Mo | 1502 | 1392 | 1% |
| 7Ni—3Fe | 1516 | 1392 | |

Figure 3:
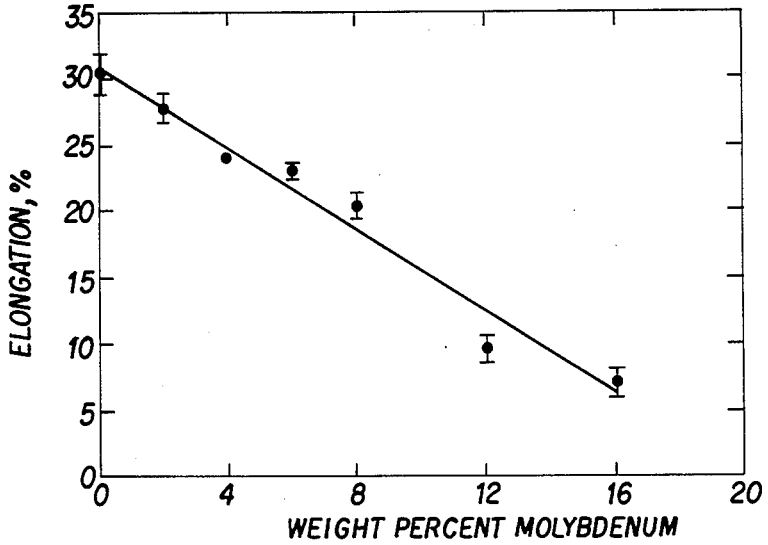
FIG. 3 is a graph showing how elongation of the as-sintered products of this invention varies with weight percent molybdenum.
Figure 4:
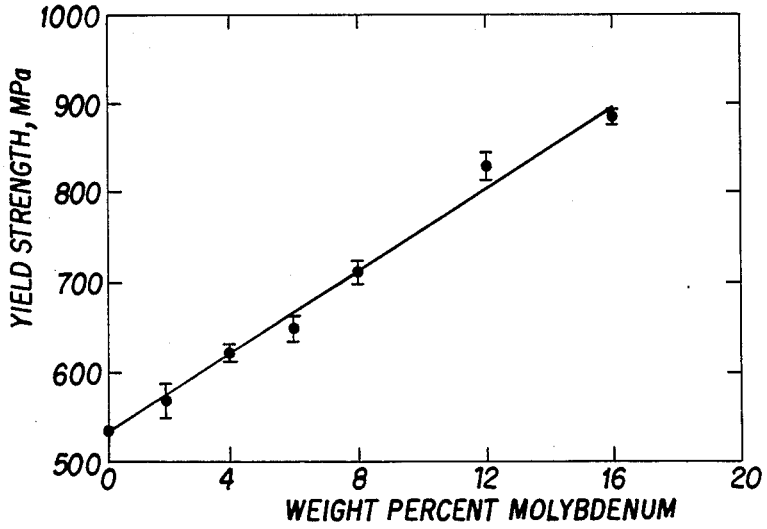
FIG. 4 is a graph showing how yield strength of the as-sintered products of this invention varies with weight percent molybdenum.
Figure 5:
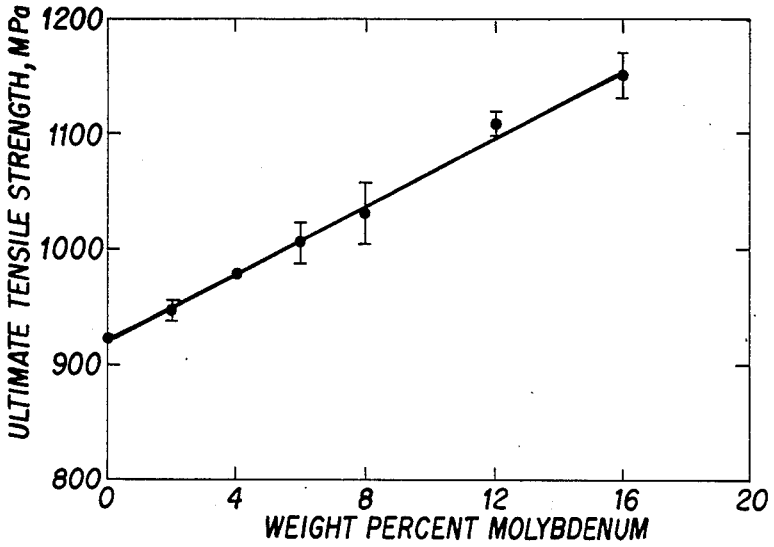
FIG. 5 is a graph showing how ultimate tensile strength of the as-sintered products of the invention varies with weight percent molybdenum.
Figure 6:
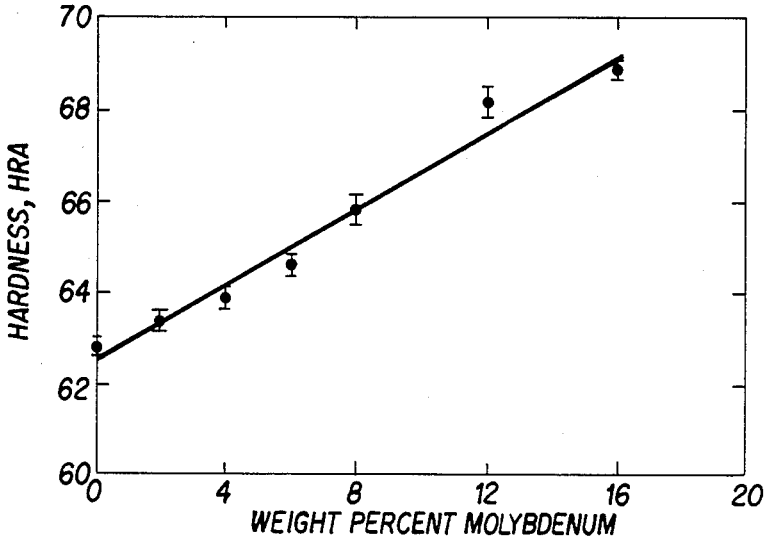
FIG. 6 is a graph showing how hardness of the as-sintered products of this invention varies with weight percent molybdenum.

FIG. 3 shows the variation in the as-sintered elongation with increasing molybdenum addition. It can be observed that with increasing molybdenum additions, the elongation decreases monotonically for the range of compositions used. The elongation drops from 31% for the classic heavy alloy with no molybdenum to around 7% for the alloy with 16 weight percent molybdenum. The variation of the yield strength, ultimate tensile strength and hardness of the heavy alloys with molybdenum are shown in FIGS. 4, 5 and 6 respectively. All of these properties increase linearly with increasing molybdenum weight percentages.

The effect of grain refinement with increasing molybdenum addition is clearly demonstrated by the series of microstructures shown in FIG. 7. It can be observed that with high (8 and 16%) molybdenum contents, the grains become slightly jagged and there is a decrease in the grain size with the emergence of a bimodal grain size distribution. The jagged nature of the grains suggests that a modification of the solution-reprecipitation step during sintering occurs in the presence of molybdenum, as suggested earlier. The average grain size for the first sample (90W-7Ni-3Fe) is about 30–35 microns. For the next sample shown (86W-4Mo-7Ni-3Fe) the average grain size is about 25 microns. The third sample (82W-8Mo-7Ni-3Fe) shows a bimodal grain distribution, the group of larger grains having an average grain size of about 15 microns. Finally, the last sample shown (74W-16Mo-7Ni-3Fe) shows a more completely developed bimodal distribution with an obvious increase in the number of relatively small grains.

A molybdenum X-ray map was taken on a 78W-12MO-7NI-3FE heavy alloy. This has been shown in FIG. 9 as a scanning electron micrograph of the alloy structure on the left and the molybdenum X-ray map of that same area on the right. It can be observed that the molybdenum is dispersed over the entire area which consists of both tungsten and matrix.

Those skilled in the art will appreciate that there are many modifications that can be made to this invention without departing from its substance. It is intended to encompass all such modifications within the scope of the following appended claims.

What is claimed is:

1. A method of making a dense alloy having high strength, high hardness, moderate ductility and a refined grain structure, said alloy being particularly useful in making kinetic energy penetrators and said method comprising the steps of:

forming a mixture of metal powders composed of a main constituent of tungsten in a proportion of 74% to 88% by weight of the mixture and a minor constituent consisting of molybdenum in a proportion of 2% to 16% by weight of the mixture, nickel and iron in respective proportions of 7% and 3% by weight of the mixture;

compressing the mixture into a compact;

liquid phase sintering of the compact in the presence of substantially only wet hydrogen gas for at least about 30 minutes; and slow cooling the sintered compact.

2. The method of claim 1 wherein the sintering step is performed in the presence of substantially only wet hydrogen gas, except for about the last ten minutes which is performed in the presence of substantially only dry Argon gas.

3. The method of claim 1 wherein the liquid phase sintering step includes the following sequence of steps:

heating the compact to about 1250° C. in the presence of substantially only dry hydrogen gas;

further heating the compact to about 1500° C. in the presence of substantially only wet hydrogen gas and holding at that temperature for at least about 30 minutes.

4. The method of claim 1 or 3 comprising the further steps of:

heat treating the sintered compact by water quenching after about a one hour hold at about 1100° C.;

thereafter swaging the compact; and strain aging the compact for about three hours at 500° C.

5. A ductile alloy having an as-sintered density of greater than 99.5% of its theoretical density made by the process of claim 1 or 5.

* * * * *

UNITED STATES PATENT AND TRADEMARK OFFICE

CERTIFICATE OF CORRECTION

PATENT NO. : 4,801,330

DATED : January 31, 1989

INVENTOR(S) : Bose et al.

It is certified that error appears in the above-identified patent and that said Letters Patent is hereby corrected as shown below:

Claim 5, line 3; "claim 1 or 5" should read "claim 1 or 4"

Signed and Sealed this

Thirty-first Day of October, 1989

*Attest:*

DONALD J. QUIGG

*Attesting Officer*

*Commissioner of Patents and Trademarks*